US007335017B2

(12) United States Patent
Wong et al.

(10) Patent No.: US 7,335,017 B2
(45) **Date of Patent: *Feb. 26, 2008**

(54) LIGHTER WITH FLINT IGNITER

(76) Inventors: Chi Lam Wong, 8259 E. Live Oak St., San Gabriel, CA (US) 91776; Lian Wang, 143 Qu Fu West Road, Shanghai (CN)

( * ) Notice: Subject to any disclaimer, the term of this patent is extended or adjusted under 35 U.S.C. 154(b) by 0 days.

This patent is subject to a terminal disclaimer.

(21) Appl. No.: 11/006,186

(22) Filed: Dec. 6, 2004

(65) Prior Publication Data

US 2005/0084814 A1 Apr. 21, 2005

Related U.S. Application Data

(62) Division of application No. 10/298,392, filed on Nov. 18, 2002, now abandoned.

(51) Int. Cl.
*F23Q 2/16* (2006.01)
*F23Q 2/173* (2006.01)
*F23Q 2/46* (2006.01)

(52) U.S. Cl. ..... 431/277; 431/278; 431/280; 431/285; 431/344

(58) Field of Classification Search ..... D27/154, D27/155, 156, 157, 158, 159, 285; 431/278, 431/280, 281, 255, 277, 129, 153
See application file for complete search history.

(56) References Cited

U.S. PATENT DOCUMENTS 1,147,315 A * 7/1915 Eddy ..... 431/278
2,433,707 A * 12/1947 Phillips ..... 431/230
2,529,094 A * 11/1950 Miller ..... 431/149
4,351,318 A * 9/1982 Ojima et al. ..... 126/208
4,458,667 A * 7/1984 Hsieh ..... 126/208
4,475,882 A * 10/1984 Gruner ..... 431/111
4,883,619 A * 11/1989 Diederich et al. ..... 264/628
5,308,240 A * 5/1994 Lowenthal ..... 431/131
6,152,725 A * 11/2000 Lee ..... 431/266
6,537,062 B1 * 3/2003 Wong et al. ..... 431/278
6,589,045 B2 * 7/2003 Xu ..... 431/255
6,699,033 B2 * 3/2004 Xu ..... 431/255
6,773,258 B1 * 8/2004 Wong ..... 431/142
6,780,006 B1 * 8/2004 Wong ..... 431/277
6,884,063 B2 * 4/2005 Wong ..... 431/255
2006/0024631 A1 * 2/2006 Wong et al. ..... 431/255

FOREIGN PATENT DOCUMENTS

DE 019857020 A1 * 6/1999
EP 0 410 313 * 7/1990

(Continued)

*Primary Examiner*—Carl D. Price
(74) *Attorney, Agent, or Firm*—Raymond Y. Chan; David and Raymond Patent Firm

(57) ABSTRACT

A lighter includes a flint igniter igniting a flame positioned adjacent to a torch nozzle thereof to light up gas emitted from the torch nozzle to form a torch in which the gas released from a gas container of the lighter is distributed to have portion emitted from a flame outlet for producing the flame while the other portion is emitted from the torch nozzle and ignited by the flame produced at the flame outlet. After lighting up the gas to form the torch, the gas from the flame outlet is blocked to stop the ignition flame.

18 Claims, 13 Drawing Sheets

FOREIGN PATENT DOCUMENTS

| | | | |
|---|---|---|---|
| GB | 2260602 | * | 4/1993 |
| JP | 06-281141 | * | 10/1994 |
| JP | 10-19255 | * | 1/1998 |
| JP | 10-160161 | * | 6/1998 |
| JP | 10-332147 | * | 12/1998 |

* cited by examiner

LIGHTER WITH FLINT IGNITER

CROSS REFERENCE OF RELATED APPLICATION

This is a divisional application of a non-provisional application, application Ser. No. 10/298,392, filed Nov. 18, 2002 now abandoned, in which the benefit of domestic priority date is claimed.

BACKGROUND OF THE PRESENT INVENTION

1. Field of Invention

The present invention relates to a lighter and, in particular, to a sort of lighter having a flint igniter and using inflammable gas as fuel stored in liquidness.

2. Description of Related Arts

Currently, lighters using inflammable gas stored in liquidness (such as butane) as fuel usually consist of the following components: a) a housing, b) a fuel container with gas outlet valve, c) a gas outlet control lever for acting on the outlet valve of the fuel container, d) an assembly connected to said outlet valve composed of a nozzle, a gas mixing chamber, a diverting nozzle and a combustion chamber, e) an electronic igniter with ignition wires.

As for lighters, they are advantageous mainly in strong wind resistance, high combustion temperature and fast ignition, which all come out of its complex structure and high precision of their constituent parts, and the operation process thereof is that fuel gas from the outlet valve gas mixing chamber and then is injected from diverting nozzle to make a strong windproof torch with high temperature. Their ignition is an impact or induction—typed electronic ignition with wires. However, it had been known that such an electronic igniter has a few defects: 1) The times an electronic ignition is extremely limited—no effective spark could be produced after 2,000-3,000 times of ignition. For a few of such lighters, their times may come up to above 5,000, but their manufacturing costs are high and once used over, they must be discarded; 2) The combustion chamber may be ignited only if the sparking point of the electronic ignition means be separated from the diverting nozzle for a certain distance and a height, or the rate of ignition success would be low or even the lighter fails to ignite. Because of such delicate requests for the separated distance and height result, the passing rate in the process of assembling the products is low, making the manufacturing cost raised; 3) The electronic igniter must have conductor wires which are covered with rubber or plastics for insulation, and the combustion chamber however has a high temperature which may take part of the conductor wires covered with rubber or plastic in the combustion chamber melted when the lighter being lighted up for a bit longer time, and further leads to deviated sparking and even failure of ignition. 4) The rubber or plastic cover of the conductor wires may be cut or pulled open during assembly process, which may result in electric leakage.

Usually, the candlelight (flames) lighters using flint ignition are in various structures. Their gas outlet valves per se are the combustion heads, and as it is very simple in their structures and there is low requirement for igniting flames, the manufacturing cost is greatly reduced. In operation, the powder generated by friction between flint and igniting wheel produces sparks, lighting up the combustion head, and since the outlet valves have large ports and simple structures, the powder falling into the ports will not form a block therein. However, as the flame generated with such structure is weak, it is difficult to light up an article in open air, and it is particularly true when it is used to light up hard or thick tobacco. If, however, the flint ignition structure of the flame lighter is applied to the aforesaid assembly to be used as a combustion head, as the dispersive sparks generated by the friction between flint and wheel are accompanied with powder, when in use, the powder will fall into diverting nozzles and narrow the nozzle's passages or block the nozzle's mini-pores, in full or in part, to disable the formation of strong windproof torch during each ignition.

Therefore, there is a need to improve its igniter so as to produce stable and high quality lighters.

SUMMARY OF THE PRESENT INVENTION

One of the main objectives of this invention is to provide a lighter with a flint igniter composed of the flint ignition structure and candle flame outlet, wherein said flint igniter structure produces sparks lighting up fuel gas from the candle flame outlet and turns it into a flame which in turn ignites fuel gas from the candle flame outlet and turns it into a flame which in turn ignites fuel gas in the combustion chamber of the assembly so as to make a strong windproof torch with high temperature. And as the sparking end of the flint of said flint igniter structure is lower than the outlet of the combustion chamber of the support frame, the block of the diverting nozzles or quick flow nozzles by the powder generated by the flint when making sparks is effectively prevented and the life of use of the lighter is prolonged.

Another objective of this invention is to provide the lighter with a flint igniter wherein a gas flow limitation structure is provided within the candle flame outlet with the single gas outlet valve structure, so as to adapt the candlelight flame and the torch flame to the needs of the users.

Another objective of this invention is to provide the lighter with a flint igniter including an operation button and sliding block to guide gas flow towards the assembly and candlelight outlet, such that the lighter may separately or simultaneously generates a windproof torch from the assembly and a flame from the candlelight outlet.

Another objective of this invention is to provide the lighter with a flint igniter wherein a cover which may be sealed or opened is provided in the second gas diverting passage and the candle flame outlet, such that the lighter may be separately or simultaneously generates a windproof torch from the assembly and a flame from the candlelight outlet.

Another objective of this invention is to provide the lighter with a flint igniter wherein a separation structure is provided between the gas mixing chamber of the assembly and the candle flame outlet, so as to better prevent flint powder from falling into the gas mixing chamber.

Another objective of this invention is to provide the lighter with a flint igniter wherein the support frame of the lighter' housing and the combustion chamber are structured separately, so as to reduce conduction of the high temperature of the combustion chamber to the lighter's body.

Another objective of this invention is to provide the lighter with a flint igniter wherein the original design of the ordinary lighter is not significantly changed so that the manufacturing cost thereof is maintained low.

The lighter with flint igniter according to the present invention includes: a housing with support frame, a fuel gas container with gas outlet, a gas outlet control lever acting on the outlet valve of the gas container, an assembly connected to a gas diverting passage on said outlet valve and composed of one filter, at least one quick flow nozzle, a gas mixing chamber, one diverting nozzle and a combustion chamber, and an igniter for igniting the gas in said combustion chamber its first embodiment is characterized in that said flint ignition structure includes a flint ignition structure or at one side of the flint ignition structure, and a second gas-diverting passage provided between the outlet valve and the assembly and connected with the candlelight gas outlet. The flint ignition structure includes an ignition wheel with a coarse edge, a flint for generating spark at its friction with the ignition wheel and a spring for pressing one end of the flint to the ignition wheel and a spring for pressing one end of the flint to the ignition wheel. The sparking end of the flint is arranged lower than the outlet of the combustion chamber of the top of the support frame to avoid the flint powder from falling into the combustion chamber and blocking the diverting nozzle's passage. The diameter of the center mini-pore of the quick flow nozzle is between 0.05-0.15 mm, which makes the gas flow from the outlet valve, after going through the quick flow nozzle, mixed with the gas flow from the outlet valve, after going through the quick flow nozzle, mixed with the gas in the gas mixing chamber so as to generate strong gas flow, making a preparation for forming a strong windproof torch with high-temperature. The second embodiment is characterized in that: the gas container is configured with a second gas outlet valve with a second gas outlet control lever, and that said flint ignition structure includes a flint ignition structure on the side of combustion chamber, a candle flame outlet provided between the combustion chamber and the flint ignition structure or at one side of the flint ignition structure and connected with said second gas outlet valve. The flint ignition structure includes an ignition wheel with a coarse edge, a flint for generating sparks at friction with the ignition wheel and a spring for pressing one end of the flint to the ignition wheel. The sparking end of the flint if arranged lower than the outlet of the combustion chamber or the top of the support frame to avoid the flint powder from falling into the combustion chamber and blocking the diverting nozzle's passage. The diameter of the center mini-pore of the quick flow nozzle is between 0.05-0.15 mm, which makes the gas flow from the outlet valve, after going through the quick flow nozzle, mixed with the gas in the gas mixing chamber so as to generate a strong sprinkling gas, and ensures the diverting nozzle to generate strong gas flow, making a preparation for forming a strong windproof torch with high-temperature.

The present invention will be better understood with further description of embodiments and by reference to the drawings as follows.

1—housing, 11—support frame, 110—top of the support frame, 2—fuel container, 21—gas box, 22—inlet gas valve, 23—outlet gas valve, 23'—second outlet gas valve, 230—gas outlet adjustment mechanism, 230'—second gas outlet adjustment mechanism, 231—gas diverting passage, 232—second gas diverting passage, 3—outlet gas control lever, 3'—second outlet gas control lever, 31—outlet gas button, 4—assembly, 41—filter, 42—quick flow nozzle, 43—gas mixing chamber, 44—diverting nozzle, 45—combustion chamber, 451—outlet port of combustion chamber, 46—wire, 5—igniter, 51—flint ignition structure, 52—candle flame outlet, 520—port of candle flame outlet, 521—gas limitation structure, 522—covering piece, 523—sealing piece, 524—hole, 525—sealing ring, 526—inlet port of the candlelight outlet, 511—ignition wheel, 5112—auxiliary wheel, 512—flint, 5121—sparking end of flint, 53—spring means, 6—sliding block, 7—button, 71, 72—reset springs, 8—separation structure.

DETAILED DESCRIPTION OF THE PREFERRED EMBODIMENT

Figure 1:
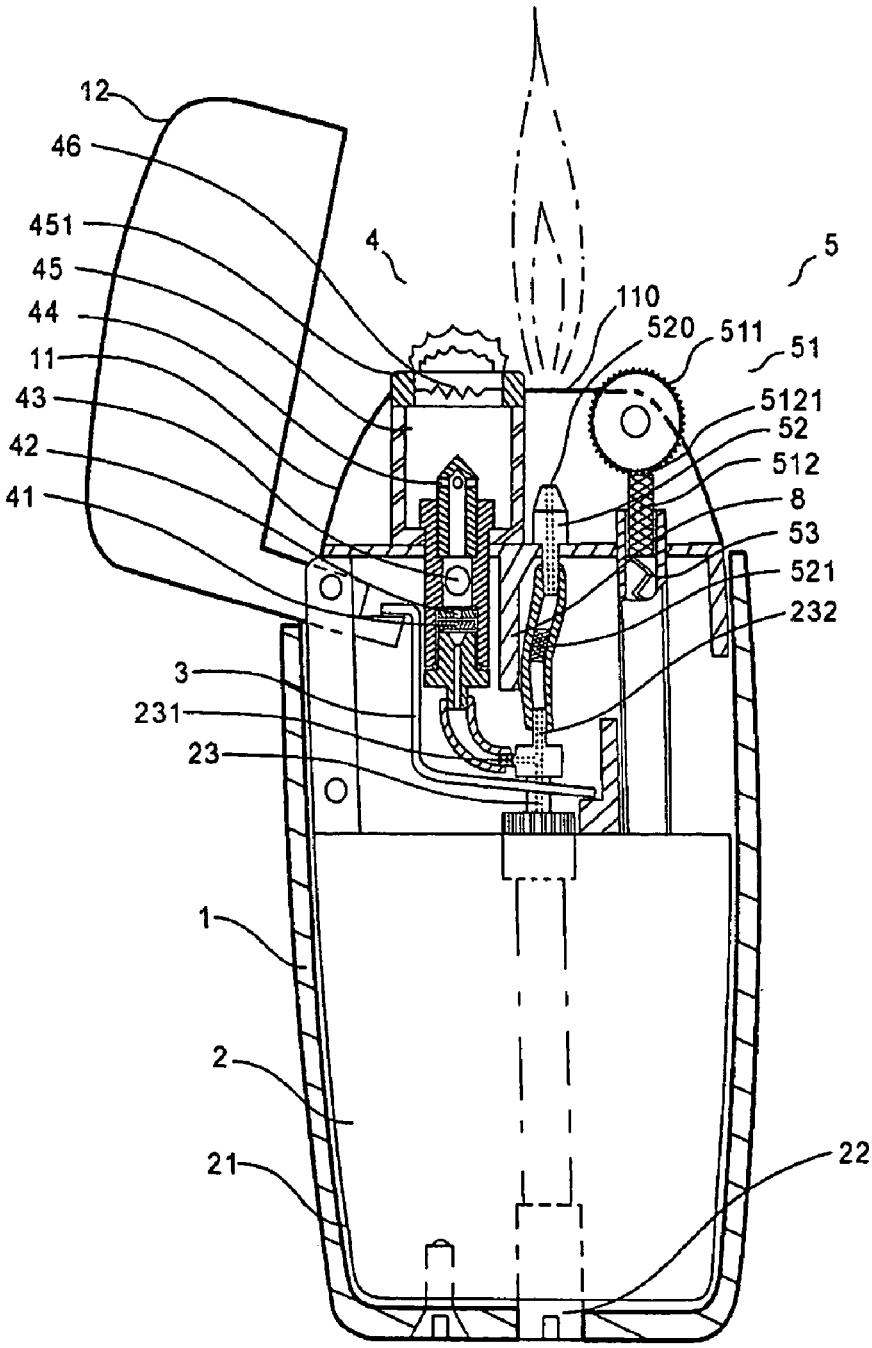
FIG. 1 is a schematic drawing showing the structure of a lighter with flint igniter according to the present invention.

Referring to FIG. 1. The preferred embodiment of the lighter with flint igniter according to the present invention includes: a housing 1 with support frame 11, a gas container 2 with outlet valve 23, and an inlet valve 22 (that may be included) for replenishing liquid fuel, an outlet control lever 3 for acting on outlet valve 23 of gas container 2, an assembly 4 connected with the gas diverting passage 231 of the outlet valve 23 and composed of a filter 41, a quick flow nozzle 42, a gas mixing chamber 43, a diverting nozzle 44 and a combustion chamber 45, igniter 5 for lighting up the gas from the combustion chamber 45, igniter 5 for lighting up the gas from the combustion chamber 45, a metal wire 46 that may be installed on the top of combustion chamber 45. Said igniter 5 includes a flint ignition structure 51 at the side of combustion chamber 45 and candle flame outlet 52 provided between the combustion chamber 45 and flint ignition structure 51. A second gas diverting pass 232 is provided between outlet valve 23 and assembly 4 and connected with the candle flame outlet 52 and has a gas flow limitation structure 521, e.g. a sponge with dense multi-pores 521, provided therewithin. Normally for multiple gas passages, fuel gas always chooses to flow towards the passage with a large diameter, and since the diameters of the mini-pores of the quick flow nozzle in the assembly 4 are between 0.05-0.15 mm, when diverted from the outlet valve 23 towards the assembly 4 and the candle flame outlet 52, most of the gas enters the latter and is turned into flame, while the assembly 4 has only insufficient gas and can not make it become windproof torch. To obtain a proper windproof torch and flame to generate a windproof torch, a gas flow limitation structure 521 for flow distribution is provided in the candle flame outlet 52, or the middle section of candle flame outlet 52 is narrowed to form the gas flow limitation structure 521 (refer to FIG. 7), or candle flame outlet 52 may be configured with mini-pores with a preferred diameter between 0.05-0.2 mm similar to that in the quick flow nozzle 42 (refer to FIG. 8) to limit the gas flow from candle flame outlet 52 and increase the gas flow towards assembly 4. The flint ignition structure 51 includes an ignition wheel 511 with coarse edge, a flint 512 for generating spark after friction with the ignition wheel 511's coarse face. Because the sparking end of the flint 512 is pressed down to contact with the coarse with the coarse surface of the ignition wheel 511, and the contact point between the flint 512 and the coarse surface of the ignition wheel 511 is called as the sparking end. When housing 1's cover 12 is opened, the outlet control lever 3 opens outlet valve 23 to release the gas. Through the action of the gas flow limitation structure 521, partial gas goes through the gas diverting passage 231 and then gets into the filter 41 of highly dense mesh to get rid of the impurity an grease in the gas and thus prevents such impurity or grease from getting into the quick flow nozzle 42 and blocking the mini-pores of the quick flow nozzle 42. Then the filtered gas gets into the quick flow nozzle 42 with the mini-pore's diameter between 0.05-0.15 mm. The gas sprinkled from the nozzle mixes with the gas in the gas mixing chamber to generate powerful mixed fuel gas which flows out from the diverting nozzle 44 of combustion chamber 45 to form strong and stable gas, while the other partial gas goes through the second gas diverting passage 232 and goes out from the outlet port of candle flame outlet 52. When the ignition wheel 511 is quickly rotated, the friction between ignition wheel 511's coarse surface and flint 512 generates dispersive sparks, lighting up the gas from the candle flame outlet 520 into a flame (thus the igniter 5 of the windproof torch is formed). Instantly, this flame lights up the gas from the assembly to generate a strong and high-temperature windproof torch. One of the key structures of the present invention is that sparking end 5121 of the flint 512 is lower than the outlet of the combustion chamber 45 of the end 110 of the support frame 11, which prevents the powder from the flint 512 from falling into the combustion chamber 45 of the assembly 4 and blocking the diverting nozzle 44 or the quick flow nozzle 42. The top 110 of the support frame 11 refers to the upper point of the support frame 11 refers to the upper point of the support frame 11 corresponding to the sparking direction of the flint 512 (refer to FIG. 9). To achieve better result, the sparking end 5121 of the flint 512 is made at least 3 mm lower than the outlet 451 of the combustion chamber 45 or the top 110 of the support frame 11. A separation structure 8 is provided between the gas mixing chamber 43 of the assembly 4 and the candle flame outlet 52 to prevent the powder generated when the flint ignition structure 51 sends the sparks to the port 520 of the candle flame outlet from falling into the mixing chamber 43 and blocking the mini-pores of the quick flow nozzle 42. The candle flame outlet 52 is lower than the outlet port of 451 of the combustion chamber 45 so that the flame from the port 520 of the candle flame outlet can easily light up the windproof torch at its side. When the cover 12 is closed, the outlet control lever 3 is released to close the gas valve 23 to extinguish the windproof torch and the fire.

Figure 2:
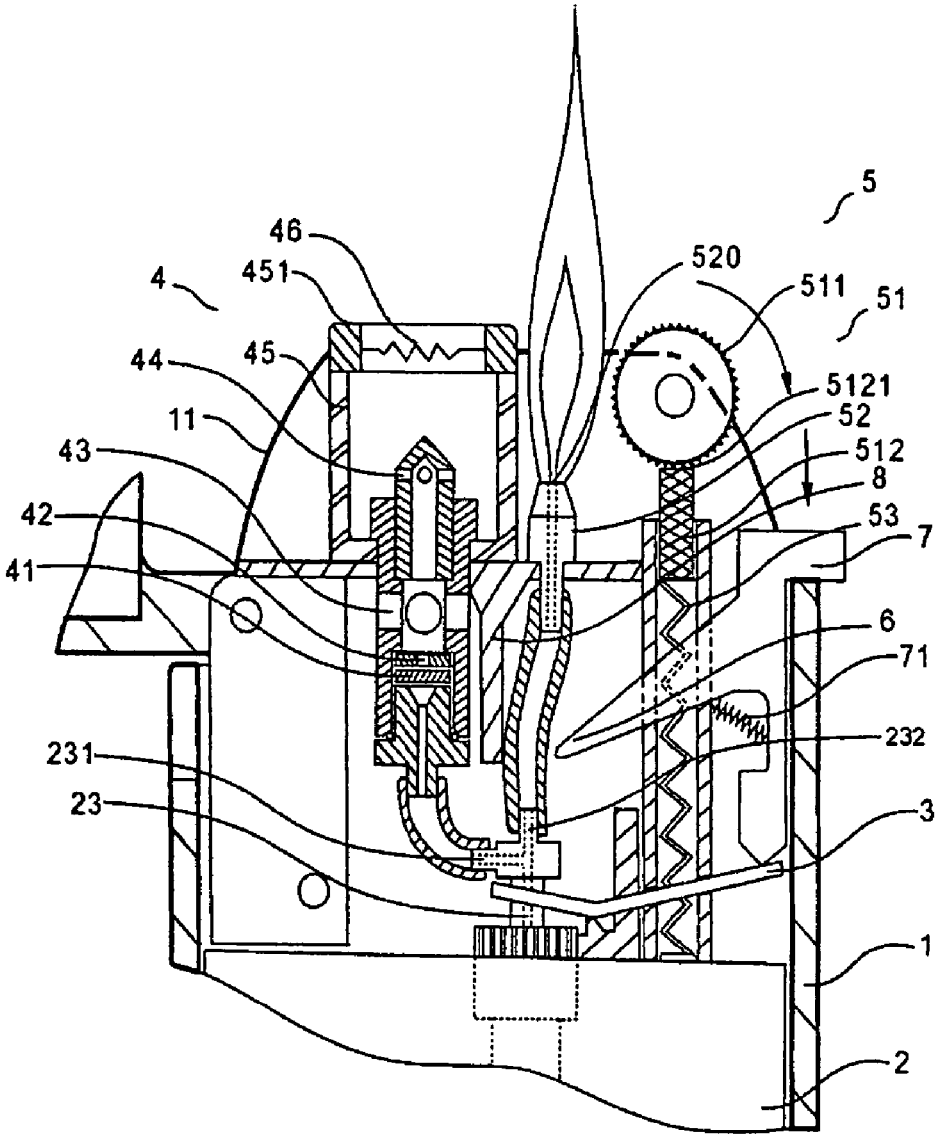
FIG. 2 illustrates the second embodiment of the present invention.
Figure 3:
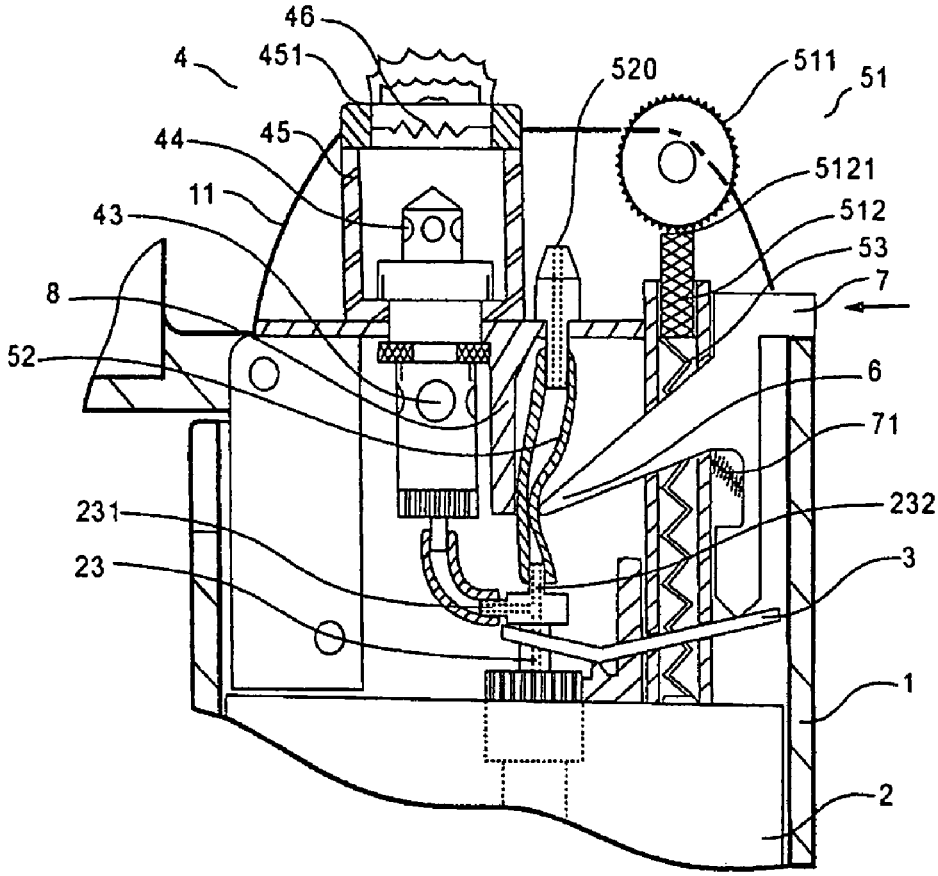
FIG. 3 is a schematic drawing showing the structure of a lighter of FIG. 2 in operation process.

Refer to FIG. 2 and FIG. 3. There is another preferred embodiment of the present invention, wherein the sliding block 6 for closing and opening said candle flame outlet for gas flow is provided at the side of said candle flame outlet 52. Partial candle flame outlet 52 may be made of flexible tubes for easy press of the sliding block 6. A button 7 is provided at the side of housing 1, and the sliding block 6 and button 7 are integrated as a whole. A reset spring 71 is arranged between the sliding block 6 and the housing 1. One end of the outlet control lever 3 is below the button 7. When the ignition wheel 511 is quickly rotated by a human finger, the quick friction between the coarse surface of the ignition wheel 511 and the sparking end 5121 generates dispersive sparks. Meanwhile, the button 7 is pressed down to further force down the outlet control lever 3. Then, the outlet control lever 3 makes the outlet valve 23 release gas. The gas goes through the second gas diverting passage 232, gets into the candle flame outlet 52 and gets out of outlet 520, and then is ignited into fire by the dispersive spark. Thus the igniter 5 of the windproof torch is formed. Then, refer to FIG. 3, push button 7 toward the inside, the sliding clock 6 instantly presses the candle flame outlet 52 to seal the gas from the candle flame outlet 52 and makes the gas flow towards the gas diverting passage 231 instead. Then the gas is supplied to the assembly 4 to provide powerful and stable mixed gas to the diverting nozzle 44 of the combustion chamber 45 and ignited into strong and windproof torch fire with high temperature by the flame at its side. When the finger is off, the reset spring 71 pulls the sliding block 6 away from the candle flame outlet 52 and the button 7 returns to its position with the action of the outlet control lever. Then, the windproof torch and fire go off.

Figure 4:
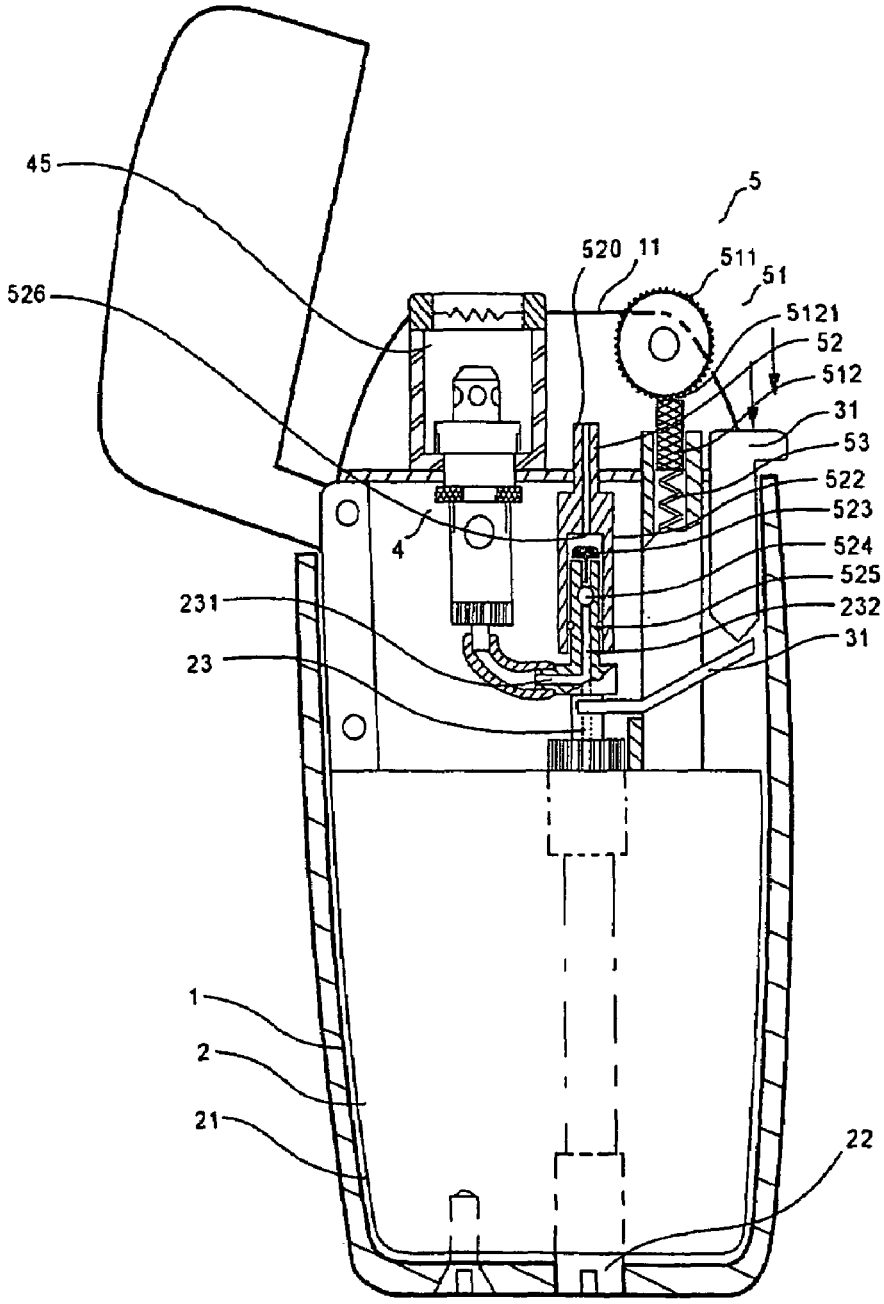
FIG. 4 illustrates the third embodiment of the present invention.

Refer to FIG. 4. There is another preferred embodiment of the present invention, wherein the principle of gas transmission from the candle flame outlet 520 to the assembly 4 is the same at that of FIG. 2. The transmission is all through the candle flame outlet's closing and opening. The differences of transmission between FIG. 4 and FIG. 2 are: the covering piece 522 is provided between the second gas diverting passage 232 and the candle flame outlet 52. The covering piece 522 and the candle flame outlet 52 are integrated as a whole. The sealing piece 523 is provided on the outlet port of the second gas flow passage 232. A hole 524 is made on the side wall of the second gas flow passage 232. Below the hole 524 is a sealing ring 525 sealing with the covering piece 522. When the ignition wheel 511 is quickly rotated, the flint's sparking end 5121 produces a dispersive spark and meanwhile, the outlet gas button 31 moves down to make the outlet control lever 3 raise the outlet valve 23 to let out the gas. The gas goes through the hole 524 on the side wall of the second gas diverting passage 232 and the gap between the second gas diverting passage 232 and the covering piece 522 to the candle flame outlet port 520. Then the gas is ignited by the flint ignition structure 51 into a flame. Thus igniter 5 is formed. When the human finger continues to press down the outlet gas button 31, the outlet gas valve 23 further moves up. Then T-shape sealing piece 523 in the second gas passage 232 blocks the inlet of the candlelight outlet 526 and the sealing ring 525 between the second gas diverting passage 232 and the covering piece 522 blocks the gas flow to force the gas in the second gas diverting 232 on the outlet gas valve 23 to flow towards the first gas passage 231 and get into the assembly 4 to form a strong mixed gas in combustion chamber 45. Instantly, the flame at the port 520 of the candle flame outlet lights up the gas in combustion chamber 45 at its side to form a strong high-temperature windproof torch.

Figure 5:
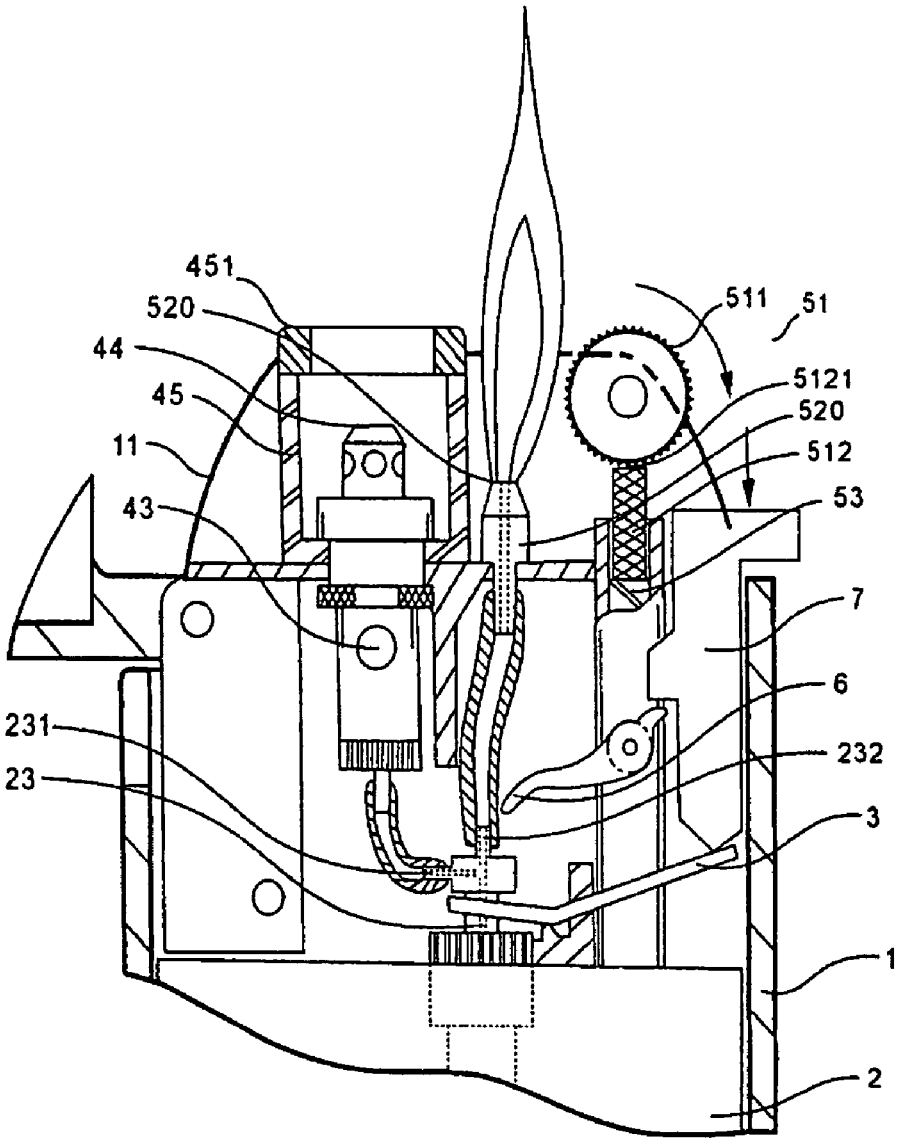
FIG. 5 is similar to FIG. 2, and the difference therebetween is that the button and sliding block are separately arranged.
Figure 6:
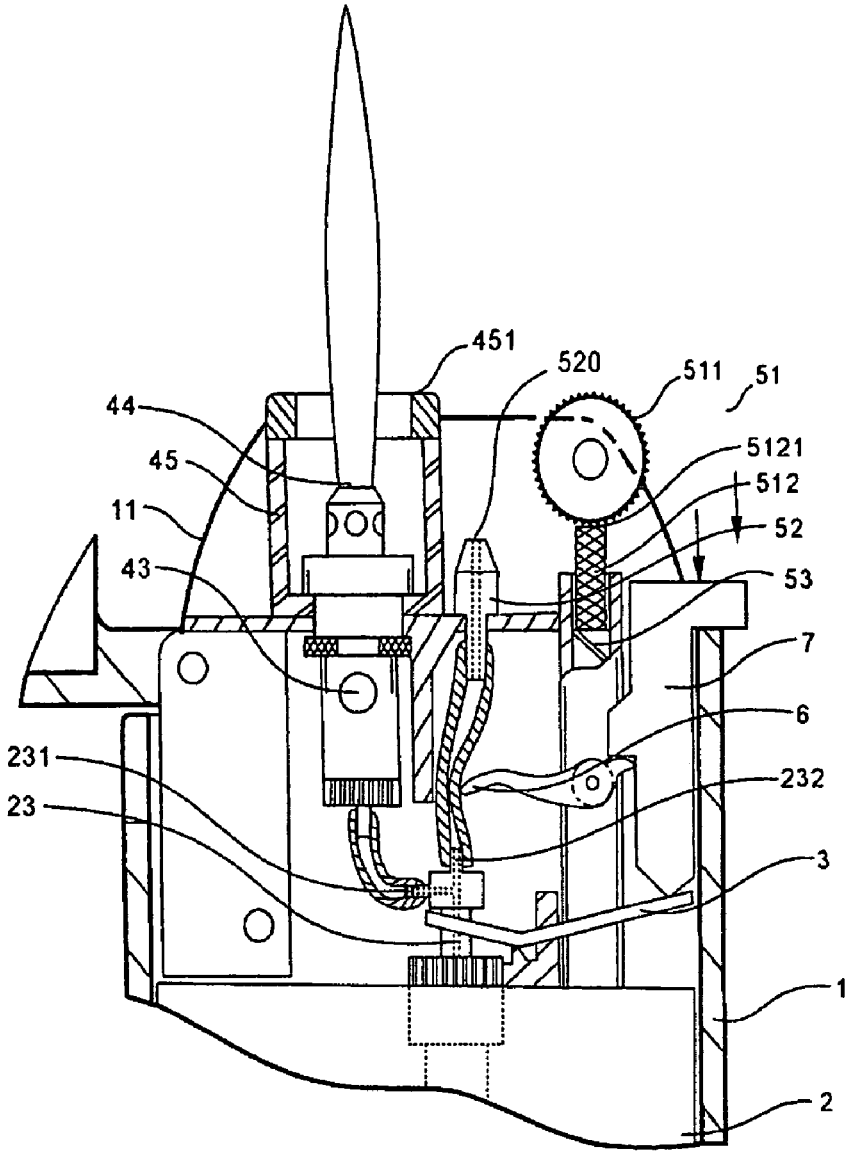
FIG. 6 is a schematic drawing showing the structure of a lighter of FIG. 5 in operation process.

Refer to FIG. 5 and FIG. 6. The structure is similar to that of FIG. 2 and FIG. 3. The difference is that button 7 and sliding block 6 are separated.

Figure 7:
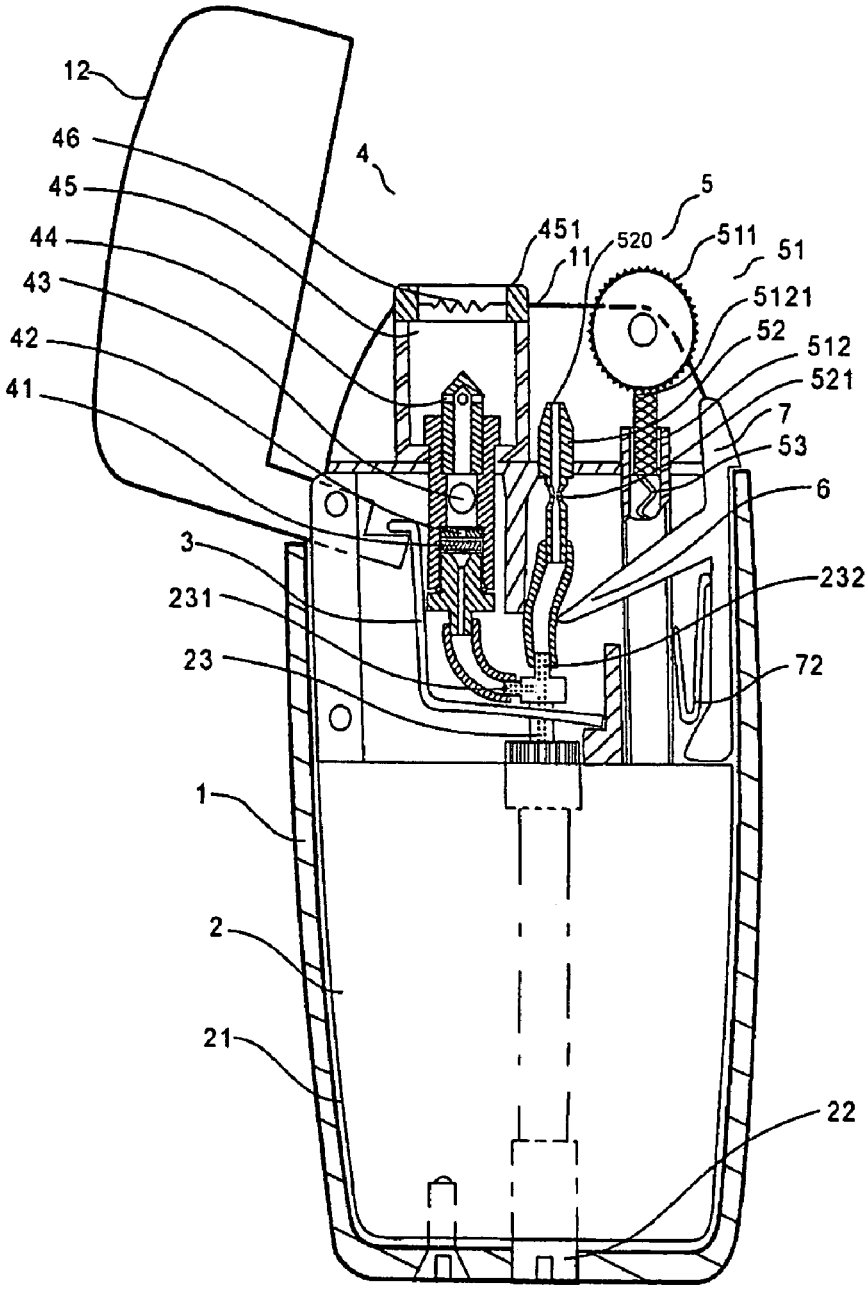
FIG. 7 is similar to FIG. 2, and the difference therebetween is that the gas outlet control lever actuates via a head cover in the housing.

Refer to FIG. 7. There is another embodiment of the present invention, wherein one end of the outlet control lever 3 is connected to one end of the cover 12 of the housing 1. When the cover 12 is opened, the outlet control lever 3 with one end connected to the cover 12 opens the outlet valve 23 to let out the gas. The button 7 is provided at the housing 1's side. The sliding block 6 and the button 7 are integrated as a whole. The reset spring 72 is provided at the button 7's side and in housing 1 so as to enable the button 7 smoothly reset after operation.

Figure 8:
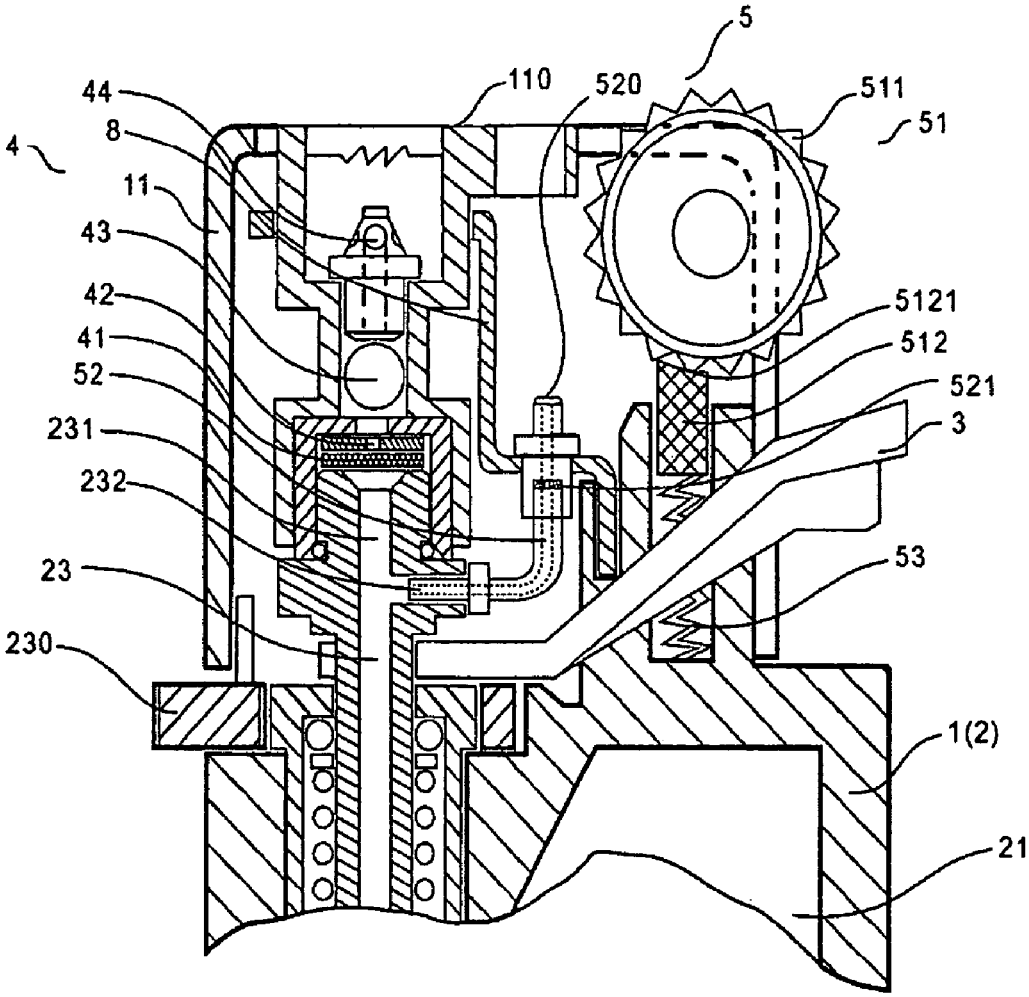
FIG. 8 illustrates the fourth embodiment of the present invention.

Refer to FIG. 8. There is another embodiment of the present invention wherein the assembly 4 and the outlet gas valve 23 are fixed together. In such case, the support frame 11 of the housing 1 and the assembly 4 can be separately structured. When the ignition wheel 511 is quickly rotated, the quick friction between the coarse surface of the ignition wheel 511 and the sparking end 5121 gives out dispersive flame. Meanwhile, the finger presses down outlet control lever 3 to make the outlet valve 23 let out the gas. And the gas flow limitation structure 520 makes the gas from outlet gas valve 23 properly distributed to the assembly 4 and the candle flame outlet 52. Then the dispersive spark lights up the gas at the outlet 520 of the candle flame outlet 52 into a flame. Thus the igniter 5 is formed. Meanwhile, the flame instantly lights up the gas in assembly 4 into strong high-temperature windproof torch. As the support frame 11 and the assembly 4 are of separately arranged structure, the heat of windproof torch in the assembly 4 is hard to be transmitted to the support frame 11 of the housing 1 so that the user will not be burnt by the windproof torch.

Figure 9:
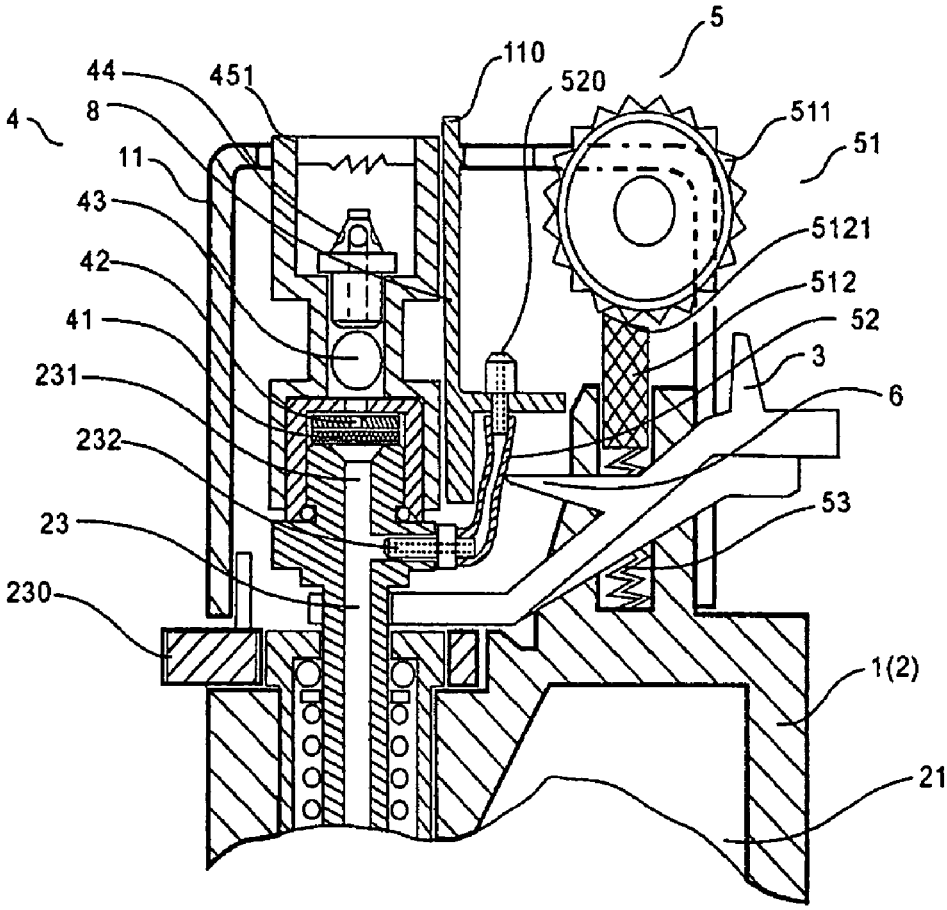
FIG. 9 illustrates the fifth embodiment of the present invention.

Refer to FIG. 9. There is another embodiment of the present invention wherein the outlet control lever 3 is movably arranged on the outlet gas valve 23 And a sliding block 6 is installed on the outlet control lever 3. When the igniting wheel 511 is quickly rotated, the dispersive spark generated by friction between the coarse surface of the igniting wheel 511 and the sparking end 5121. Meanwhile, the finger presses down the outlet control lever 3 to make the outlet gas valve 23 let out the gas. Most gas goes through the second gas diverting passage 232 and the candle flame outlet 52 and then goes out the port 520 of the candle flame outlet, and then ignited into a flame by the flint ignition structure 51. Thus the igniter 5 is formed. When the finger presses the outlet control lever 3 towards the inside, the sliding block 6 fixed on the outlet control lever 3 presses partial soft material of the candle flame outlet 52 to close the candle flame outlet 52. Meanwhile, the gas from the outlet gas valve 23 instantly turns to gas diverting passage 231 to provide the assembly 4 with mixed gas which if lighted up by igniter 5. Then the light generates strong windproof torch and the flame goes off after the gas in the candle flame outlet 52 is transmitted.

Figure 10:
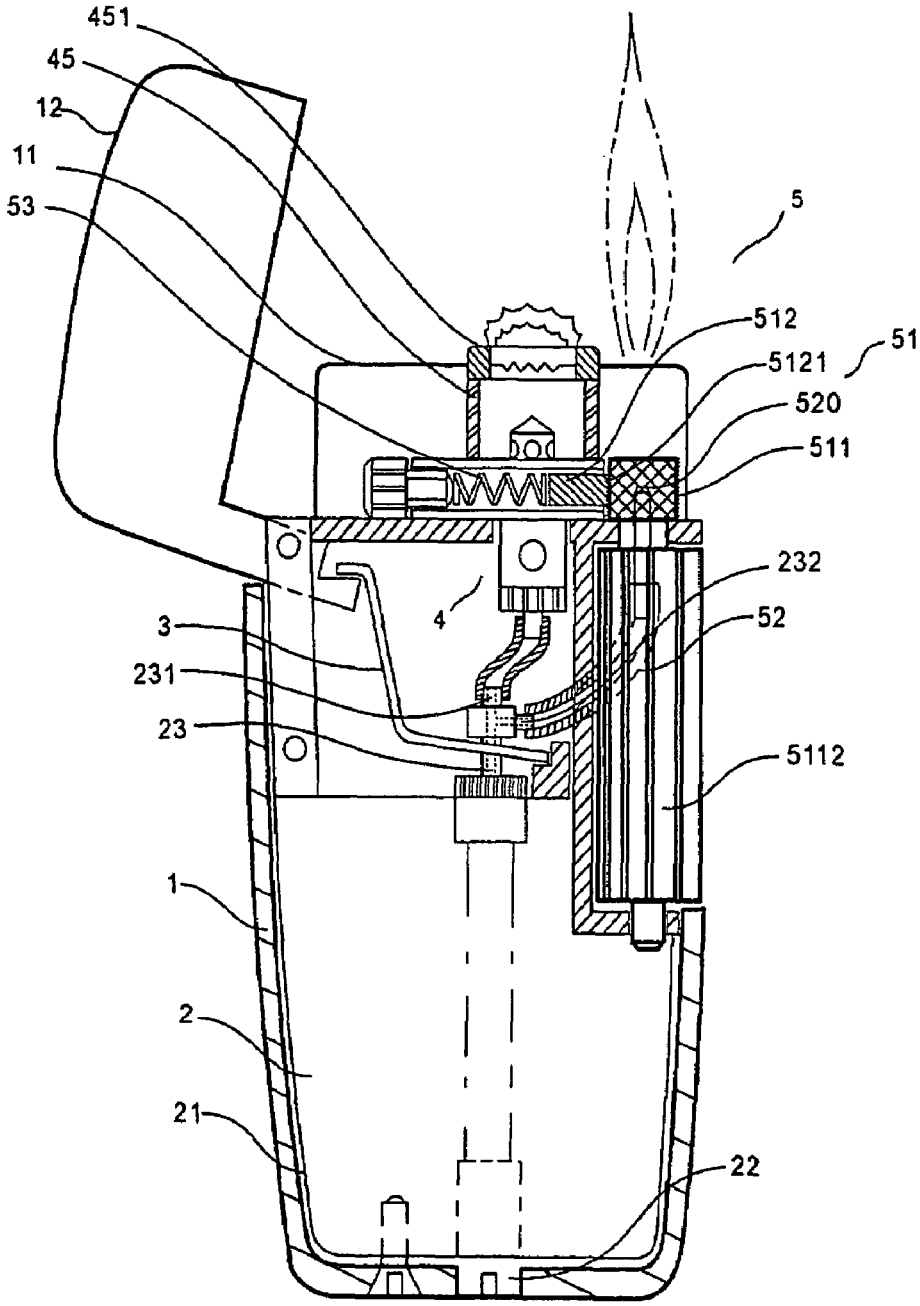
FIG. 10 illustrates the sixth embodiment of the present invention.

Refer to FIG. 10. There is another embodiment of the present invention wherein the igniter 5 includes a flint ignition structure 51 provided at the side of combustion 45 and a candle flame outlet 52 provided on one side of the flint ignition structure 51. The flint ignition structure 51 includes an ignition wheel 511, a flint 512 and a spring 53 or an auxiliary wheel 5112 connected to the central axle of the ignition wheel 511. When a user uses the lighter, his finger can turn the auxiliary wheel 5112 to drive the ignition wheel 511.

Figure 11:
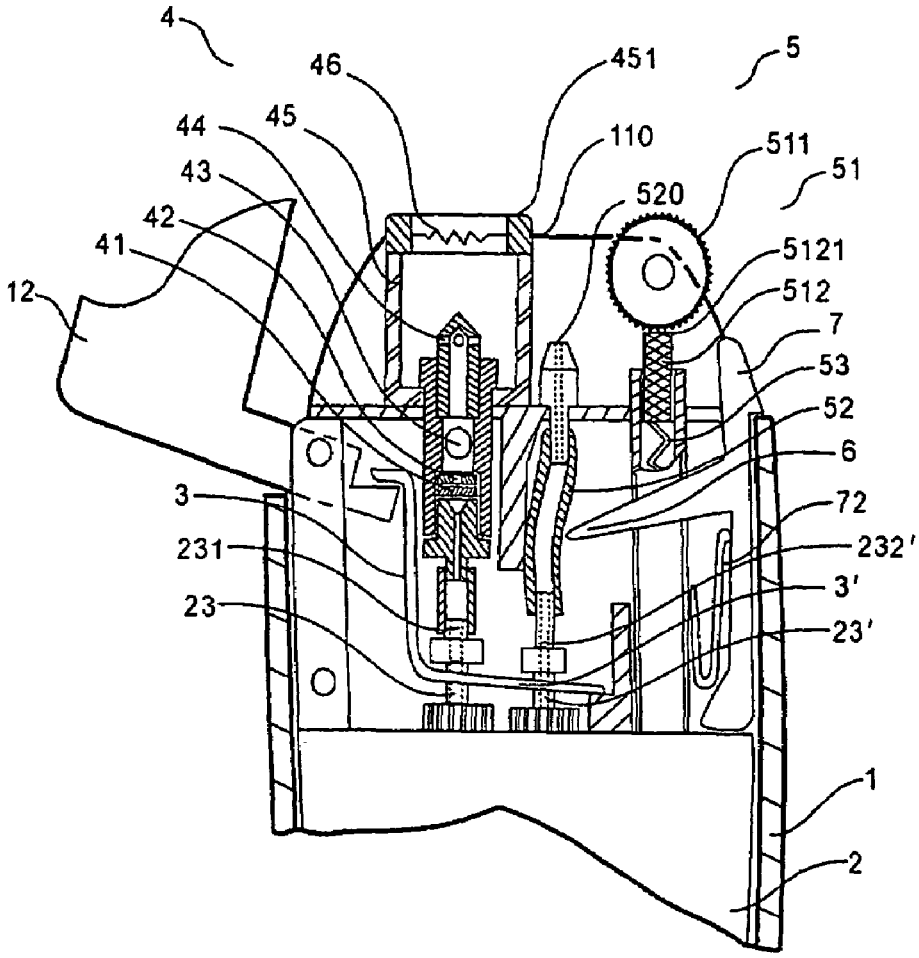
FIG. 11 illustrates the seventh embodiment of the present invention.

Refer to FIG. 11. There is a second embodiment of the present invention wherein the lighter includes: a housing 1 with a support frame 11, a fuel container 2 with outlet valve 23, a gas diverting passage 231 on the outlet valve 23, a assembly 4 connected with the gas diverting passage 231 on the outlet valve 23 and composed of a filter 41, a quick flow nozzle 42, a gas mixing chamber 43, a diverting nozzle 44 and a combustion chamber 45, and an igniter 5 lighting up the gas in the combustion chamber 45. Said combustion chamber 45 may have a metal wire 46 provided on the upper part thereof, and there is second outlet valve 23' configured in the gas container 2, on which a second outlet control lever 3' is configured thereon. Said igniter includes a flint ignition structure provided on the side of the combustion chamber 45 and a candle flame outlet 52 provided between said flint ignition structure 51 and said combustion chamber 45. A gas diverting passage 232' is arranged between the second outlet valve 23' and the candle flame outlet 52. Said candle flame outlet 52 is connected with said second outlet valve 23' through the gas diverting passage 232', and the candle flame outlet 52 is lower than the outlet of said combustion chamber 45, such that the flame generated by the candle flame outlet 52 may easily light up the windproof torch at its side. The flint ignition structure 51 includes an ignition wheel 511 with a coarse edge, a flint 512 for generating sparks at its friction with the ignition wheel 511 and a spring means 53 for pressing and sparking end 5121 of the flint 512 to contact with said ignition wheel 511. On the side of said candle flame outlet 52, a sliding block 6 for closing and opening the flexible part of the candle flame outlet 52, and a button 7 is provided at the side of the housing 1. The sliding block 6 and the button 7 are integrated or separated (see FIG. 5), and the reset spring 72 may be installed on said button 7. When the cover 12 is opened, one end of cover 12 lifts up the outlet control lever 3 and the second outlet control lever 3' connected to the outlet control lever 3 making the outlet valve 23 and the second outlet valve 23' release gas. The diameter of the mini-pores of the quick flow nozzle 42 in the assembly 4 is between 0.05-0.15 and thus constitutes some resistance to gas flow, while the candle flame outlet 52 usually has a larger hole for the gas flows through easily. So, the most of the gas, having come out of the outlet 23' and entered the candle flame outlet 52, forms a gas flow at the outlet 520. When the human finger quickly rotates ignition wheel 511, the dispersive spark generated at the quick friction between the coarse surface of the ignition wheel 511 and the sparking end 5121 lights up the gas from the candle flame outlet port 520 and turns it into a flame. Thus the igniter 5 is formed. And thereafter, when the button 7 is pressed towards the inside, the sliding block 6 on the button 7 instantly presses the candle flame outlet 52, blocking the gas flow in the candle flame outlet 52, making the gas turn to the outlet valve 23 and get into the assembly 4 and providing to the diverting nozzle 44 of the combustion chamber 45 with a strong and stable mixed inflammable gas, which may instantly be ignited by the flame at its side to form a strong and high-temperature windproof torch. At the same time, the flames go off. One of the key structures according to the present invention is that sparking end 5121 of the flint 512 is lower than the outlet 451 of the combustion 45, or the top end 110 of the support frame 11, and thus prevents flint 512's powder which would block the diverting nozzle 44 or the quick flow nozzle 42 from falling into the combustion chamber 45 of the assembly 4 when flint 512 sends spark to candle flame outlet. The top end 110 of the support frame 11 refers to the high point of support frame 11 corresponding to the sparking direction of the flint 512 (refer to FIG. 9). A better results could be achieved if the sparking end 5121 of the flint 512 is made 3 mm (or more) lower than the outlet 451 of the combustion chamber 45 or the top end 110 of the support 11' A separation structure 8 is provided between the gas mixing chamber 43 of the assembly 4 and the candle flame outlet 52 to prevent the powder generated when the flint ignition structure 51 sends a spark to the candle flame outlet port 520 from falling into the gas mixing chamber 43 and blocking the mini-pores of the quick flow nozzle 42.

Figure 12:
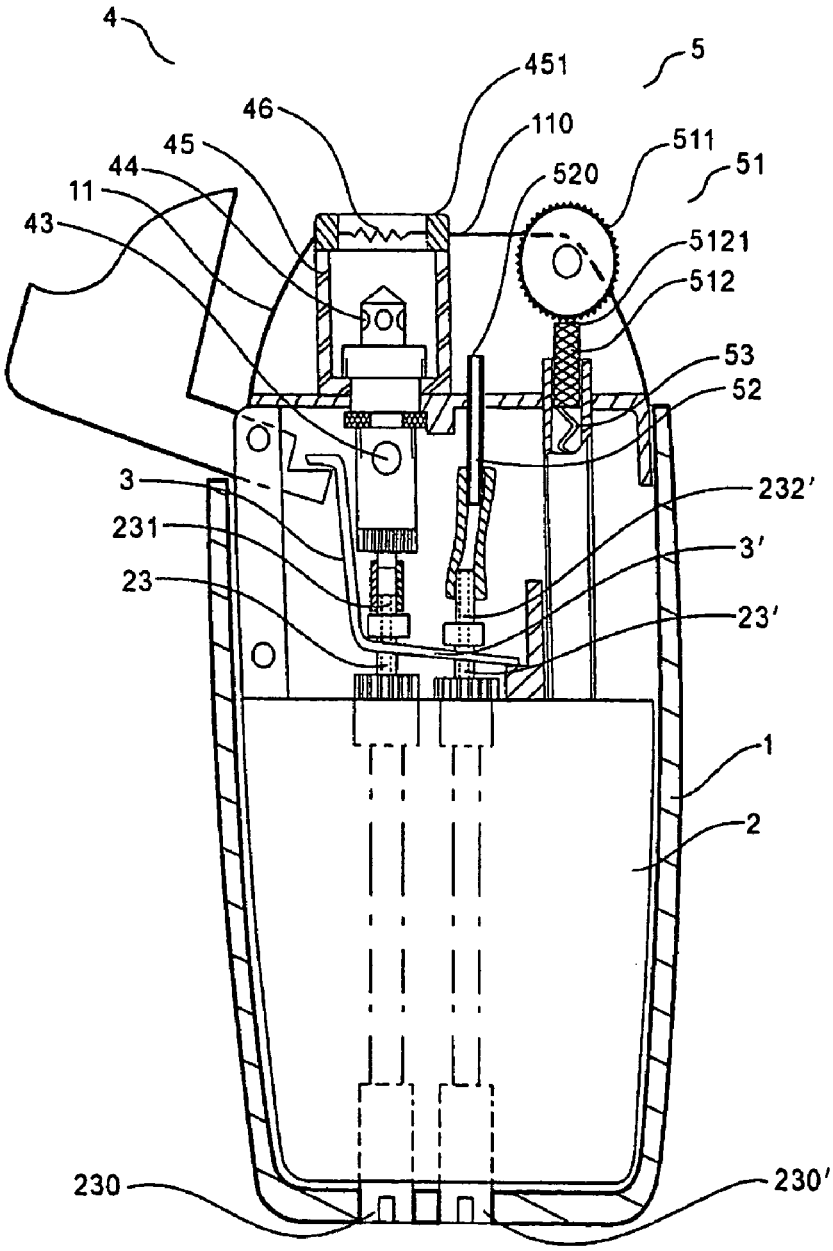
FIG. 12 illustrates the eighth embodiment of the present invention.

Refer to FIG. 12. The flint igniter structure 51 sends spark to light up the gas at the candle flame outlet 520 to generate the flame and light up the windproof torch. In operation, the flame and windproof torch exist at the same time. The main reason of the above is that the gas outlet adjustment mechanism 230 enlarges the passage of the outlet valve 23 and the gas outlet adjustment mechanism 230' narrows the passage of the second outlet valve 23', making equal the distribution of gas in the assembly 4 and the candle flame outlet 52, which further makes the flame and windproof torch occur simultaneously.

Figure 13:
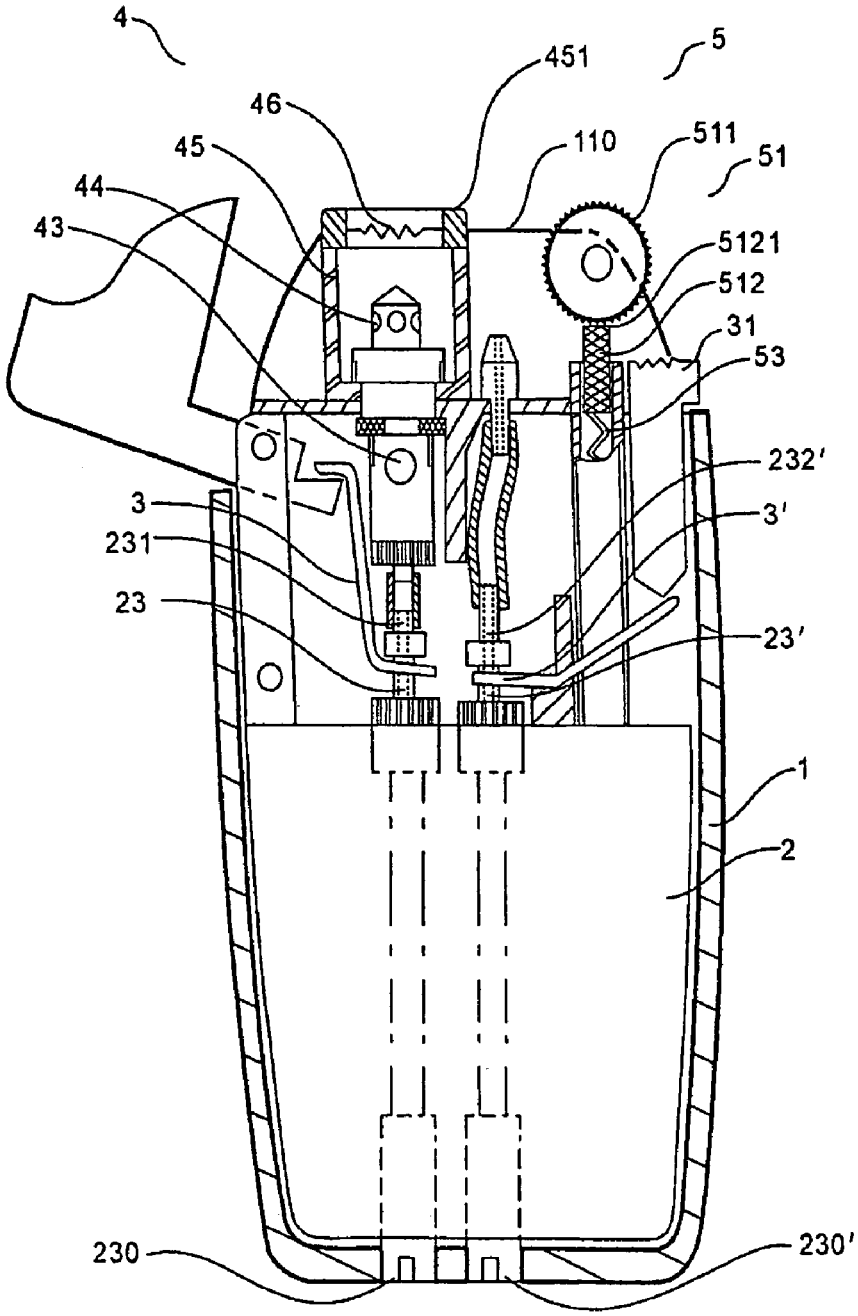
FIG. 13 illustrates the ninth embodiment of the present invention.

Refer to FIG. 13, similar to FIG. 12. The differences are: the outlet adjustment mechanism 3 of the outlet valve 23 has one end connected to one end of the cover 12. When the cover 12 is opened, the outlet valve releases the gas. The second outlet adjustment mechanism 3' of the second outlet valve 23' is in connection with the outlet button 31 at housing 1's side. When the outlet button 31 is pressed down, it makes the second outlet controller 3' raise the second outlet valve 23' and thus let out gas.

The above preferred embodiments are only for description for the invention and cannot be construed as any limitation to the present invention. Those who are skilled in the art may make various changes and variation thereto within the spirit and scope of the present invention. Thus all the equivalent alternative technical solutions are to be deemed within the scope of the present invention which is defined by the claims herewith.

What is claimed is:

1. A method of igniting a cigar/cigarette by a lighter having a torch nozzle and a flame outlet, comprising the steps of:

(a) emitting gas from a gas container to said torch nozzle and said flame outlet via a first diverting passage and a second diverting passage respectively;

(b) striking a coarse surface of an ignition wheel against a flint to produce sparks towards said flame outlet to form a flame when said gas is emitted from said flame outlet through said second diverting passage; and (c) selectively switching said lighter to produce said flame and a torch, wherein during said flame is produced at said flame outlet, said second diverting passage is arranged to be deformed to block said gas passing through said second diverting passage so as to guide said gas passing through said first diverting passage, wherein, at the same time, said flame at said flame outlet ignites said gas emitting from said torch nozzle to form a torch before said flame is off, wherein when said second diverting passage restores to an original shape, said gas re-passes said second diverting passage such that said flame is re-produced while said torch is off.

2. The method, as recited in claim 1, wherein said second diverting passage is a flexible tube whereby gas passing therethrough is blocked when said sliding block presses thereon.

3. The method, as recited in claim 2, wherein said flame outlet is positioned lower than said torch nozzle for igniting said gas emitted from said torch nozzle to form said torch.

4. A method of igniting a cigar/cigarette by a lighter having a torch nozzle and a flame outlet, comprising the steps of:

(a) emitting gas from a gas container to said torch nozzle and said flame outlet via a first diverting passage and a second diverting passage respectively;

(b) striking a coarse surface of an ignition wheel against a flint to produce sparks towards said flame outlet to form a flame when said gas is emitted from said flame outlet through said second diverting passage;

(c) igniting said gas emitting from said torch nozzle by said flame to form a torch; and (d) selectively switching said flame and said torch by selectively blocking said gas passing through said second diverting passage, wherein the step (d) further comprises the steps of:

(d.1) pressing a push button on said housing; and (d.2) pushing a sliding block by said push button to press on said second diverting passage to block said gas passing therethrough, such that said torch is produced while said flame is off.

5. The method as recited in claim 4, in step (a), further comprising a step of opening a housing cap of said lighter to open a gas valve for emitting said gas from said gas container to said first and second diverting passages, wherein when said housing cap is closed, said gas valve is closed to stop said gas releasing from said gas container.

6. The method, as recited in claim 5, wherein said second diverting passage is a flexible tube whereby gas passing therethrough is blocked when said sliding block presses thereon.

7. The method, as recited in claim 4, wherein said second diverting passage is a flexible tube whereby gas passing therethrough is blocked when said sliding block presses thereon.

8. The method, as recited in claim 7, wherein said flame outlet is positioned lower than said torch nozzle for igniting said gas emitted from said torch nozzle to form said torch.

9. The method, as recited in claim 4, wherein said flame outlet is positioned lower than said torch nozzle for igniting said gas emitted from said torch nozzle to form said torch.

10. A lighter for cigarette and cigar, comprising:

a housing comprising a support frame, a gas container for containing gas, an ignition wheel rotatably supported on said support frame for a finger of a user driving to rotate, and a push button slidably mounted on said support frame for said finger of said user pressing on said push button;

a gas valve communicating with said gas container for controlling said gas emitting therefrom, wherein said gas valve has a first diverting passage and a second diverting passage;

a torch nozzle supported on said support frame, wherein said first diverting passage is communicatively extended to said torch nozzle for guiding said gas flowing towards said torch nozzle;

a flame outlet provided on said support frame adjacent to said torch nozzle, wherein said second diverting passage is communicatively extended to said flame outlet for guiding said gas flowing towards said flame outlet;

a flint igniter which includes a flint and a resilient element for pressing said flint in contacting with said ignition wheel, wherein said flame outlet is positioned between said flint igniter and said torch nozzle, wherein when said ignition wheel is rotated to strike against said flint, sparks are produced towards said flame outlet to ignite said gas emitted from said flame outlet to produce a flame, wherein said flame ignites said gas emitted from said torch nozzle to produce a torch; and a gas flow limitation structure comprising a sliding block which is supported in said housing and is arranged in such a manner that when said push button is pushed into said housing, said sliding block is driven to block said gas passing through said second diverting passage;

whereby, said user is able to operate said lighter to selectively produce said flame and said torch such that when said finger of said user rotates said ignition wheel to produce said sparks, said flame is produced, and when said finger of said user presses on said push button, said torch is produced while said flame is off.

11. The lighter, as recited in claim 10, wherein said flame outlet is positioned lower than said torch nozzle for igniting said gas emitted from said torch nozzle to form said torch.

12. The lighter, as recited in claim 11, wherein said second diverting passage is a flexible tube whereby gas passing therethrough is blocked when said sliding block presses thereon.

13. The lighter, as recited in claim 12, wherein said push button is integrally extended from said sliding block and is mounted on top of said housing such that when said push button is pushed towards said housing, said sliding block is pushed to press on said second diverting passage to block said gas passing therethrough.

14. The lighter, as recited in claim 13, further comprising a housing cover movably supported on said housing, wherein said gas valve comprises an outlet control lever which is coupling with said housing cover and arranged in such a manner that when opening said housing cover, said outlet control lever opens said gas valve to release said gas from said gas container and when closing said housing cover, said outlet control lever is released to close said gas valve.

15. The lighter, as recited in claim 12, further comprising a housing cover movably supported on said housing, wherein said gas valve comprises an outlet control lever which is coupling with said housing cover and arranged in such a manner that when opening said housing cover, said outlet control lever opens said gas valve to release said gas from said gas container and when closing said housing cover, said outlet control lever is released to close said gas valve.

16. The lighter, as recited in claim 10, wherein said second diverting passage is a flexible tube whereby gas passing therethrough is blocked when said sliding block presses thereon.

17. The lighter, as recited in claim 16, wherein said push button is integrally extended from said sliding block and is mounted on top of said housing such that when said push button is pushed towards said housing, said sliding block is pushed to press on said second diverting passage to block said gas passing therethrough.

18. The lighter, as recited in claim 10, further comprising a housing cover movably supported on said housing, wherein said gas valve comprises an outlet control lever which is coupling with said housing cover and arranged in such a manner that when opening said housing cover, said outlet control lever opens said gas valve to release said gas from said gas container and when closing said housing cover, said outlet control lever is released to close said gas valve.

* * * * *